430-58 SR
6/23/87 DR 4,675,262

United States Patent [19]
Tanaka

[11] Patent Number: 4,675,262
[45] Date of Patent: Jun. 23, 1987

[54] MULTILAYER ELECTROPHOTOGRAPHIC PHOTOSENSITIVE ELEMENT HAVING CHARGE TRANSPORT LAYER CONTAINING POWDERED MATERIAL HAVING SPECIFIED REFRACTIVE INDEX

[75] Inventor: Shigemori Tanaka, Tokyo, Japan

[73] Assignee: Canon Kabushiki Kaisha, Tokyo, Japan

[21] Appl. No.: 817,558

[22] Filed: Jan. 10, 1986

[30] Foreign Application Priority Data

Jan. 16, 1985 [JP] Japan ..... 60-3985

[51] Int. Cl.[4] ..... G03G 5/14
[52] U.S. Cl. ..... 430/58; 430/945

[58] Field of Search ..... 430/58, 94 S, 59, 66, 430/67

[56] References Cited

U.S. PATENT DOCUMENTS 4,489,148 12/1984 Horgan ..... 430/67

*Primary Examiner*—J. David Welsh
*Attorney, Agent, or Firm*—Fitzpatrick, Cella Harper & Scinto

[57] ABSTRACT

An electrophotographic photosensitive member comprises a charge generation layer and a charge transport layer, the charge transport layer containing powders having a refractive index different from that of the charge transport layer excluding the powders.

6 Claims, 3 Drawing Figures

MULTILAYER ELECTROPHOTOGRAPHIC PHOTOSENSITIVE ELEMENT HAVING CHARGE TRANSPORT LAYER CONTAINING POWDERED MATERIAL HAVING SPECIFIED REFRACTIVE INDEX

BACKGROUND OF THE INVENTION

1. Field of the Invention

The present invention relates to an electrophotographic photosensitive member and more particularly, to an electrophotographic photosensitive member suitable for laser printer.

2. Description of the Prior Art

Heretofore, as a photosensitive member for a printer of electrophotographic system using a coherent light represented by laser as a light source, there have been used selenium, selenium series alloys, cadmium sulfide dispersed in resin, charge transfer complex of polyvinyl carbazole and trinitrofluorenone and the like.

As a laser, there have been used gas lasers such as helium-cadmium, argon, helium-neon and the like. However, there have been recently used semiconductor lasers which are small, inexpensive, and can be directly modulated. However, the wavelength of emitted light of most semiconductor lasers is 750 nm or more, and conventional photosensitive members are of low photosensitivity at such wavelength range and are used with difficulty. Therefore, laminate type photosensitive members constituted of a charge transport layer and a charge generation layer which can relatively freely select the photosensitive wavelength region have recently drawn attention.

The charge generation layer of the laminate type photosensitive member absorbs light to generate free electric charge, and the thickness of the charge generation layer is usually as thin as 0.1–5 μm so as to shorten the moving distance of the generated photo-carrier. The thickness of the charge generation layer is thin in order that most of the incident light may be absorbed in the charge generation layer to generate many photo-carriers and further the generated photo-carriers may be injected into the charge transport layer without being deactivated by recombination and trapping. As the charge transport layer, there is used a material capable of accepting electrostatic charge and transporting free electric charge and substantially incapable of absorbing an image forming light. The thickness of the charge transport layer is usually 5–30 μm. When such a laminate type photosensitive member is used for forming images by line-scanning with a laser light by means of a laser printer, there can be produced good line images such as letters and the like, but when solid images are to be formed density irregularities, there are produced in the form of an interference fringe.

The formation of density irregularities seems to be attributable to a limited absorption of the light quantity in the charge generation layer, since the thickness of the layer is thin and the light having passed through the charge generation layer is reflected at the surface of the substrate and interference occurs between the resulting reflected light and the reflected light at the surface of the photoconductive layer.

A laminate type electrophotographic photosensitive member is constituted such that, as shown in FIG. 2, a charge generation layer 2 and a charge transport layer 3 are successively laminated to a metallic conductive support 1. When a laser beam 6 (the oscillating wavelength being about 780 nm in the case semiconductor laser and about 630 nm in the case of helium-neon laser) strikes the laminate type photosensitive member, there occurs interference between a light 7 indicent upon the charge transport layer 3 and a reflected light 8 resulting from another light 7 incident upon the charge transport layer 3 reaching the surface of the metallic conductive support 1, reflected there and exiting the surface of the charge transport layer 3.

Assuming that the refractive index of the laminated charge generation layer 2 and charge transport layer 3 is n and the thickness of the laminate is d and the wavelength of laser beam is λ, when nd is a whole number multiple of λ/2, the intensity of reflected light is maximum, that is, the intensity of the light entering the charge transport layer is minimum (according to law of conservation of energy), while when nd is an odd number multiple of λ/2, the intensity of reflected light is minimum, that is, the light entering the charge transport layer is maximum. It is inevitable due to the accuracy in the fabrication that d has a fluctuation of thickness of about 0.2 μm. On the other hand, it is considered that the laser beam is so monochromatic and coherent that the condition for interference changes corresponding to the irregularity of the thickness d. The quantity of laser beam absorbed in the charge generation layer is different from place to place results in irregularity of density of solid image in a form an of interference fringe. When ordinary copying machines are used, the width of irregularity of density in form an of interference fringe is varied depending upon the wavelength and is an average value because the light source is not monochromic, and thereby the irregularity of density is not seen.

Heretofore, in electrophotographic methods using laser beam, generation of irregular density in a form of interference fringe has been prevented, for example, by roughening the reflecting surface of a substrate and the interface between the ground layer and the photosensitive layer to form unevenness so as to cause phase difference of the reflected light beams. However, such surface roughening makes the photosensitive layer formed on the uneven surface nonuniform in the case of a laminate type photosensitive member and therefore there are caused disadvantages such as defective images and remarkably lowered photographic characteristics.

SUMMARY OF THE INVENTION

An object of the present invention is to provide an electrophotographic photosensitive member free from the above-mentioned drawbacks.

Another object of the present invention is to provide an electrophotographic photosensitive member where generation of irregular density in a form of interference fringe is prevented by diffusing a laser beam without roughening the substrate and the interface between the laminated layers.

A further object of the present invention is to provide an electrophotographic method by which an irregular density in a form of interference fringe is not formed.

According to one aspect of the present invention, there is provided an electrophotographic photosensitive member comprising a charge generation layer and a charge transport layer, the charge transport layer containing powders having a refractive index different from that of the charge transport layer excluding the powders.

According to another aspect of the present invention, there is provided an electrophotographic method which comprises charging an electrophotographic photosensitive member and irradiating with a laser beam, the electrophotographic photosensitive member comprising a charge generation layer and a charge transport layer, the charge transport layer containing powders having a refractive index different from that of the charge transport layer excluding the powders.

DESCRIPTION OF THE PREFERRED EMBODIMENTS

Figure 1:
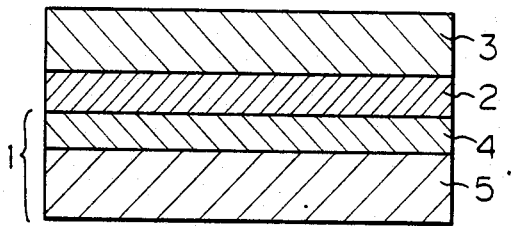
FIG. 1 is a cross sectional view of an electrophotographic photosensitive member.
Figure 2:
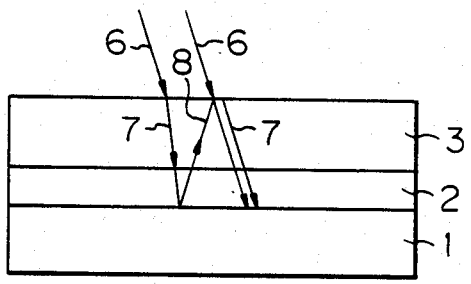
FIG. 2 shows light paths of light incident upon an electrophotographic photosensitive member.
Figure 3:
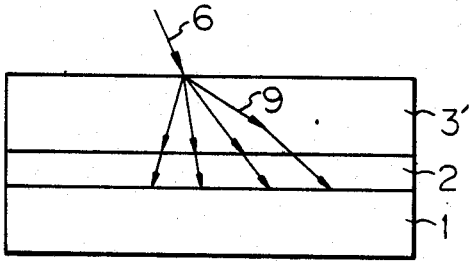
FIG. 3 shows light paths of light incident upon an electrophotographic photosensitive member according to the present invention.

According to the present invention, the electrophotographic photosensitive member can immediately solve the problems resulted from providing separately a layer for preventing interference as mentioned above since the charge transport layer itself functions as an interference preventing layer. According to the present invention, the fine particles dispersed in the charge transport layer scatter the incident laser beam to change a single beam to diffused beams, and therefore, the above-mentioned problems can be solved. That is, the directions of the reflected lights from the support are not the same, but the reflected light beams are directed to various different directions so that the width of the irregular density in a form of interference fringe is dispersed and averaged resulting in disappearing of the interference fringe.

The present invention will be explained below referring to the drawings.

A representative structure of the electrophotographic photosensitive member having a charge generation layer and a charge transport layer is shown in FIG. 1, that is, a photosensitive layer constituted of a charge generation layer 2 and a charge transport layer 3 overlies an electroconductive support 1.

Electroconductive support 1 is constituted of a support 5 and an electroconductive layer 4 overlying the support 5. The support 5 may be electroconductive or not. For example, as an electroconductive support 5, there may be used an aluminum cylinder and an aluminum sheet, and as a non-conductive support 5, there may be used a polymer film, a polymer cylinder, or a composit material composed of materials selected from paper, plastic and metal.

As a resin in which electroconductive pigment powders, and if desired, particles for forming surface unevenness are dispersed, there may be used any resin satisfying the conditions: (1) strong adhesivity to a support, (2) good dispersability of powders, (3) a sufficient solvent resistance, and the like. In particular, there is preferably used a thermosetting resin such as curable rubbers, polyurethane resins, epoxy resins, alkyd resins, polyester resins, silicone resins, acryl-melamine resins and the like. The volume resistivity of the resin in which electroconductive powders are dispersed is desirably less than $10^{13}$ ohm.cm, preferably, less than $10^{12}$ ohm.cm. Therefore, it is desirable that the content of the electroconductive powders in the coated film is 10–60% by weight. For dispersion, there may be used conventional means such as roll mill, vibrating ball mill, attritor, sandmill, colloid mill and like. For coating, when the substrate is sheet-like, there is suitably used wire-bar coating, blade coating, knife coating, roll coating, screen coating or the like, and when the substrate is a cylinder, a soaking coating is preferable.

The charge generation layer 2 may be produced by dispersing a charge generating material, for example, an azo pigment such as Sudan red, Diane blue, Janus green B and the like, a quinone pigment such as Algol yellow, pyrene quinone, Indanthrene brilliant violet RRP and the like, quinocyanine pigment, perylene pigment, indigo pigment such as indigo, thioindigo and the like, bisbenzimidazole pigment such as Indo-fast orange toner and the like, phthalocyanine pigment such as copper phthalocyanine, aluminum chloride-phthalocyanine and the like, quinacridone pigment, and the like, in a binder resin such as polyesters, polystyrene, polyvinyl butyral, polyvinyl pyrrolidone, methyl cellulose, polyacrylic esters, cellulose esters and the like. The thickness of the charge generation layer is usually about 0.01–1$\mu$, preferably about 0.05–0.5$\mu$.

The charge transport layer 3 may be formed by applying a liquid coating material composed of a hole transporting material dissolved or dispersed in a film shapeable resin and drying the liquid coating material thus applied. As the hole transporting material, there may be used a compound having, at the main chain or side chain, a polycyclic aromatic compound moiety such as anthracene, pyrene, phenanthrene, coronene and the like, or a nitrogen-containing cyclic compound such as indole, carbazole, oxazole, isoxazole, thiazole, imidazole, pyrazole, oxadiazole, pyrazoline, thiadiazole, triazole and the like, or a hydrazone compound. The thickness of charge transport layer 3 is preferably 5–20$\mu$.

It is a feature of the present invention that powders having a refractive index different from that of the charge transport layer excluding the powders are incorporated in the charge transport layer 3.

As the powder material, there may be mentioned, for example, alumina ($Al_2O_3$: refractive index 1.77), silica ($SiO_2$: refractive index 1.54), titanium oxide ($TiO_2$: refractive index 2.7), zinc oxide (ZnO: refractive index 2.03), cerium oxide ($CeO_2$: refractive index 2.6), polyvinylidene fluoride (PVF), ferric chloride ($Fe_2O_3$: refractive index 2.94), zinc sulfide (ZnS: refractive index 2.37), potassium iodide (KI: refractive index 1.67), magnesium oxide ($Mg_2O$: refractive index 1.74), cadmium sulfide (CdS: refractive index 2.51), polyvinylidene chloride (PVdC: refractive index 1.60–1.63), Teflon powders (refractive index 1.4), acrylonitrile resin (refractive index 1.39), benzoic acid (refractive index 1.51), copper sulfate (refractive index 1.36), butyral resin powders, magnesium chloride, sodium carbonate, magnesium sulfate, potassium chloride, calcium chloride, sodium chloride, silver chloride, nickel sulfate, ammonium thiocyanate, and the like. In addition, there may be used body pigments such as asbestos (Ca-Mg-silicate), clay, kaolin, potter's clay-Japanese acid clay-china clay (aluminum silicate), diatomaceous earth, aleuron ($CaCO_3$), gypsum ($CaSO_4.2H_2O$), talc ($3MgO.4SiO_2.H_20$), barite ($BaSO_4$), mica powder ($Al_2O_3.K_2O.SiO_2$) and the like; white pigments such as antimony white ($Sb_2O_3$), lithopone ($ZnS+BaSO_4$), zinc white and the like; black pigments such as carbon black, gas black, iron black, black iron oxide, graphite, manganese dioxide, chromium black and the like; red pigments such as red iron oxide, colcothar, red lead, toluidine red and the like; green pigments such as chromium oxide, cobalt chromium green, and the like; blue pigments such as ultramarine, cobalt blue and the like; violet pigments such as violet iron oxide, Mars violet and the like; and further, aluminum powder, stainless steel powder, glass frit and the like.

Furthermore, among organic pigments, there may be used azo pigments, triphenylmethane pigments, quinoline pigments, anthraquinone pigments, phthalocyanine pigments and the like.

Preferable range of the particle size (average particle size) is 0.1–10μ, particularly, 0.1–1μ.

According to the present invention, the abovementioned powders are incorporated in the charge transport layer preferably in an amount of 0.1–10% by weight. The incorporating procedure may be effected, for example, by dissolving the above-mentioned hole transporting material in a film-shapeable resin and incorporating the powders therein followed by dispersing sufficiently using, for example, a propeller agitator or sand mill.

As the film-shapeable resin, there may be used, for example, polymethyl methacrylate (refractive index about 1.4), polystyrene (refractive index about 1.6), polyester (refractive index about 1.5), styrene-methyl methacrylate copolymer resin (refractive index about 1.5), and the like. Refractive index of the hole transporting material is about 1.4–1.5, and the refractive index of the charge transport layer varies depending on refractive index of the film-shapeable resin incorporated.

It is desirable that the difference in refractive index between the charge transport layer and the powder is large, but the difference is usually 0.01 or more, preferably 0.11 or more.

In the electrophotographic photosensitive member composed of a charge generation layer and a charge transport layer according to the present invention, when the charge generation layer is nearer to the support than the charge transport layer, the interference preventing effect is large. However, even when the charge transport layer is nearer to the support than the charge generation layer, there is still an interference preventing effect. The electroconductive layer may be omitted.

If desired, there may be provided an underlying layer having both barrier function and adhesion function between the electroconductive layer and the photosensitive layer. The underlying layer may be formed with casein, polyvinyl alcohol, nitrocellulose, ethyleneacrylic acid copolymers, polyamides (nylon 6, nylon 6—6, nylon 6–10, copolymer nylon, alkoxymethylated nylon and the like), polyurethane, gelatin, aluminum oxide or the like. The thickness of the underlying layer is usually 0.1–5μ, preferably 0.5–3μ.

EXAMPLE 1

100 parts by weight of electroconductive titanium oxide powder (produced by Titan Kogyo), 100 parts by weight of titanium oxide powder (manufactured by Sakai Kogyo, K.K.) and 125 parts by weight of phenolic resin (Plyophene, tradename, produced by Dainippon Ink K.K.) were dissolved in a solvent composed of 50 parts by weight of methanol and 50 parts by weight of methylcellosolve and dispersed for 6 hours by means of a ball mill.

The resulting dispersion was applied to an aluminum cylinder (60ϕ×260 mm) by a soaking coating and then subjected to heat-curing at 150° C. for 30 min. to form an electroconductive layer of 20μ thick. The surface roughness of the electroconductive layer was 1.5 μm.

Then, 10 parts ("parts by weight" hereinafter unless otherwise specified) of a copolymer nylon resin (AMYLAN, CM 8000, tradename, produced by Toray Co. Ltd.) was dissolved in a mixture of 60 parts of methanol and 40 parts of butanol, and applied to the abovementioned intermediate layer by means of soaking to produce a polyamide resin layer of 1μ thick.

Copper phthalocyanine of ϵ type (manufactured by Toyo Ink K.K.) 100 parts by weight, butyral resin (manufactured by Sekisui Kagaku K.K.) 50 parts by weight and cyclohexane 1350 parts by weight were dispersed for 20 hours by means of a sandmill using glass beads of 1 mm in size. To the resulting dispersion was added 2700 parts by weight of methyl ethyl ketone, and the resulting mixture was coated on the abovementioned polyamide resin layer by soaking and dried by heating for 10 min. at 50° C. to produce a charge generation layer of 0.15 g/m$^2$.

Then, 10 parts of a hydrazone compound of the formula,

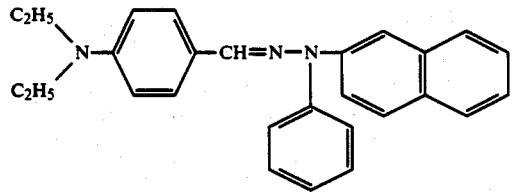

and 15 parts of styrene-methyl methacrylate copolymer (MS 200, tradename, produced by Seitetsu Kagaku K.K.) were dissolved in 80 parts of toluene. The refractive index of the solid matter was 1.54. To the resulting solution was added one part of alumina powders (refractive index 1.77) (particle size 1μ) and dispersed for one hour by a sandmill dispersing machine. The resulting mixture was applied to the above-mentioned charge generation layer and dried by a hot air at 100° C. for one hour to form a charge transport layer of 16μ thick.

The resulting laminate type photosensitive drum was fixed to a laser printer experimenting machine (charging negatively) having a gallium-aluminum-arsenic semiconductor laser (wavelength of emitted light 780 nm, output 5 mw) and imaging was effected. As the result, there was produced images which were free from irregularity of density caused by interference fringes, had a uniform image density at the solid image portion and had sharp line images.

COMPARISON EXAMPLE 1

By repeating the procedure of Example 1 to form an electroconductive layer, an underlying layer and a charge generation layer, but forming a charge transport layer by using the corresponding composition in Example 1 except that aluminum powders were omitted, there was produced a photosensitive drum for comparison.

The resulting photosensitive drum for comparison was fixed to the above-mentioned laser printer experimenting machine to form images. The line images thus obtained were good, but the solid images had irregular density due to interference.

EXAMPLE 2

Repeating the procedures of Example 1, there were formed an electroconductive layer, an underlying layer, and a charge generation layer. Then, a charge transport layer composition as used in Example 1 except that one part of $SiO_2$ powders (refractive index 1.54, particle size 0.5μ) was used in place of alumina powders (particle size 1μ), was stirred for 30 min. by a propeller agitator to disperse.

The resulting mixture was applied to the charge generation layer to produce an electrophotographic photosensitive member, which was used for forming images by the same procedure as in Example 1 resulting in formation of images which were free from irregularity of density due to interference fringe, had uniform density at the solid image portion and had sharp line images.

COMPARISON EXAMPLE 2

Repeating the procedures of Example 2 except that $SiO_2$ powders were omitted in the charge transport layer, there was produced an electrophotographic photosensitive member.

Following the procedure of Example 1, images were formed. The line images were good, but the solid images had a fringe pattern due to interference.

EXAMPLE 3

Repeating the procedure of Example 1, there were formed an electroconductive layer, an underlying layer, and charge generation layer. Then, a charge transport layer composition as used in Example 1 except that 2 parts of polyvinylidene chloride powder (refractive index 1.60–1.63, particle size 0.2μ) was used in place of alumina powder, was stirred and dispersed for 30 min. by a propeller agitator.

The resulting mixture was applied to the charge generation layer to produce an electrophotographic photosensitive member. Following the procedure of Example 1 to produce images using the photosensitive member thus produced, there were obtained images free from irregularity of density due to interference, having uniform density at the solid image portions and sharp line images.

According to the present invention, the electrophotographic photosensitive member can afford clear electrophotographic images free from an interference fringe-like irregularity of density after imagewise exposure and development.

Such a technical advantage is particularly remarkable where a coherent light, in particular, laser beam, is used as a light source for image exposure, and the photosensitive member can be very advantageously used as an electrophotographic photosensitive member for laser printers. In addition, it is not necessary to roughen the substrate of the photosensitive member and the interface between the laminated layers of the photosensitive layer, and therefore, the surfaces can be smooth so that defects are very little. As a result, the image quality can be improved and pinholes are not formed even at a repeated copying of many times.

What is claimed is:

1. An electrophotographic photosensitive member which comprises a charge generation layer and a charge transport layer, the charge transport layer containing powder material having a refractive index different from that of the charge transport layer excluding the powder material.

2. The electrophotographic photosensitive member according to claim 1 in which the difference in refractive index between the charge transport layer excluding the powder material and containing the powder material is 0.01 or more.

3. The electrophotographic photosensitive member according to claim 2 in which the difference in refractive index is 0.11 or more.

4. The electrophotographic photosensitive member according to claim 1 in which the charge transport layer comprises a charge transporting material, a resin and the powder material.

5. An electrophotographic method which comprises charging an electrophotographic photosensitive member and irradiating with a laser beam, the electrophotographic photosensitive member comprising a charge generation layer and a charge transport layer, the charge transport layer containing powder material having a refractive index different from that of the charge transport layer excluding the powder material.

6. The electrophotographic method according to claim 5 in which the laser is a semiconductor laser.

* * * * *